United States Patent [19]

Baumann et al.

[11] Patent Number: 4,971,600

[45] Date of Patent: Nov. 20, 1990

[54] ARRANGEMENT FOR GASIFYING FUEL

[75] Inventors: Hans-Richard Baumann; Adolf Linke, both of Essen; Hans-Reiner Schweimanns, Hattingen; Karl-Heinz Dutz, Herten, all of Fed. Rep. of Germany

[73] Assignee: Krupp Koppers GmbH, Essen, Fed. Rep. of Germany

[21] Appl. No.: 339,236

[22] Filed: Apr. 14, 1989

[30] Foreign Application Priority Data

Apr. 21, 1988 [DE] Fed. Rep. of Germany ..... 3813357

[51] Int. Cl.[5] ..... C10J 3/48; C10J 3/50

[52] U.S. Cl. ..... 48/86 R; 48/76; 48/DIG. 4

[58] Field of Search ..... 48/86 R, 76, DIG. 4; 406/193, 195, 181

[56] References Cited

U.S. PATENT DOCUMENTS

| | | | |
|---|---|---|---|
| 2,477,414 | 7/1949 | McBride | 406/195 |
| 3,144,276 | 8/1964 | Ortiz | 406/195 |
| 3,204,942 | 9/1965 | Matthys et al. | 48/86 R |
| 3,337,273 | 8/1967 | Farnsworth | 406/195 |
| 4,554,721 | 11/1985 | Carty et al. | 406/193 |

FOREIGN PATENT DOCUMENTS 3509221.1 3/1984 Fed. Rep. of Germany .

*Primary Examiner*—Peter Kratz

*Attorney, Agent, or Firm*—Michael J. Striker

[57] ABSTRACT

An arrangement for gasification of fuels within the range from fine grain fuel to dust shaped fuels, in a dust cloud with gas comprises a gasification reactor provided with at least two burners, a supply container for accommodating a fuel, a distributor connected to the supply container for receiving the fuel from the supply container, and a plurality of conduits connected with the distributor and supplying the fuel from the latter to the burners, the conduits having a different geometrical parameter including at least one of a length and a direction.

6 Claims, 2 Drawing Sheets

1
2
3
4
5
6
7
8
9
10
11
12
13
13
13
20

ARRANGEMENT FOR GASIFYING FUEL

BACKGROUND OF THE INVENTION

The present invention relates to an arrangement for gasifying fuels. More particularly, it relates to an arrangement for gasifying fuels within the range from fine grain to dust-like fuels in a dust cloud with oxygen and/or air and in some cases water steam in a gasifying reactor which is provided with at least two burners located in a plane in the side wall of the reactor.

The autothermal gasification of the fine grain-dust-like fuels with an average grain size from approximately 50 um in the dust cloud with oxygen and/or air and in some cases with water steam has been known for a long time under the name Koppers-Totzek process. In accordance with this process a fuel to be gasified and the reaction medium are blown through the burner into an empty gasification reactor and converted there into a crude gas by partial oxidation and temperatures above the slag melting point. The crude gas can be processed to synthetic gas or fuel gas. When this process is performed under normal pressure, the fuel can be supplied to the burners through a screw conveyor which allows a sufficient quantity regulation. The fuel is first supplied by the screw conveyor first to a so-called mixing head, and from there it is blown by the stream of the gaseous or vaporous reaction media through the burner head into the gasification reactor. More recently there has been a tendency to develop this process further so that the gasification can be performed with increased pressure between 10 and 100 bar, preferably between 25 and 45 bar. The pressure version of the Kopper-Totzek process is identified as PRENFLO process. In this case the screw conveyor is hardly suitable for the transportation of the fuel to the burners. Instead, a pneumatic conveyance with preferably inert conveying gas is utilized.

The gasification in the dust cloud requires an exact arrangement of the fuel and reaction medium. Gasification reactors with high throughput are provided for example with two or more burners. For an optimal operational result, a fuel supply of a uniform quantity and uniform shape must be provided to all burners of the gasification reactor. In normal case the deviation region of the supply stream density during the fuel supply must be only approximately ±2%.

For solving this problem it has been proposed in the German document No. DE-OS 3,509,221 to connect each pair of the burners of a gasification reactor with a common fuel supply device by symmetrically arranged conduits. This solution requires satisfying certain symmetry requirements with respect to the positioning of the fuel supply device and the conduit path to the gasification reactor. With two or more gasification burners also additional fuel supply devices are required in this case. These requirements lead to respective investment and operation costs and do not provide an optimal solution of the above mentioned problem.

SUMMARY OF THE INVENTION

Accordingly, it is an object of the present invention to provide an arrangement for gasification of fuels, which avoids the disadvantages of the prior art.

More particularly, it is an object of the present invention to provide an arrangement of the above mentioned type in which the fuel supply of a uniform quantity and shape to all burners of a gasification reaction is insured.

It is also an object of the present invention to provide such a uniformity with low apparatus expenses and to permit a conduit path for the fuel supply to the burner within wide limits.

In keeping with these objects and with others which will become apparent hereinafter, one feature of the present invention resides, briefly stated, in an arrangement for gasification of fuel in which all burners of a gasification reactor are supplied from a single supply container through a distributor, and the conduits for the fuel supply from the distributor to the individual burners have different lengths and/or different directions (paths).

When the arrangement is designed in accordance with the present invention, contrary to the teaching of the German document No. DE-OS 3,509,221 the symmetrical conduits for the fuel supply to the burners of the gasification reactor are dispensed with. The conduits can be of different lengths, and/or different directions (paths). Thereby operational requirements as well as requirements for maintenance and repair can be satisfied in an optimal manner.

In accordance with another feature of the present invention, different pressure losses due to different lengths and/or directions of the conduits (number of deviations) can be equalized by special means provided in each conduit. These means can be formed as throttles arranged in the conduits. Instead of the throttles, also regulating valves of a conventional design can be utilized. In the conduit in which a maximum pressure loss is expected, such means can be dispensed with.

It should be emphasized that in the inventive arrangement all burners of the gasification reactor are supplied with fuel from an individual supply container. This is especially advantageous when the gasification reactor has more than two burners. With modern, large installations corresponding to the present state of the art, the gasification reactor is provided with more than two burners, which advantageously are arranged in pairs. When the number of the burners is greater for example than 6, the arrangement of the burners in pairs can also be dispensed with. They can be distributed over the whole periphery of the gasification reactor in one plane. In all above mentioned cases, the fuel supply of the burners is performed from single supply container, which leads to considerable saving in apparatus and operational costs. It should be taken into consideration that each supply container can be associated with the required transporting or sluice device for bringing the fuel coming from a preparation installation to a required operational pressure and transferring the same into the supply container.

In the inventive arrangement the conduits for the fuel supply to the burners are connected with a distributor which is supplied with fuel from the supply container. This distributor is located as close as possible under the outlet of the supply container and connected with the latter by a rigid transporting conduit. An addition of a transporting gas in this conduit is dispensed with. Four conduits for the fuel supply to the burners normally extend from the distributor. However, if the number of the burners in the gasification reactor is greater, two or more distributors can be used in correspondence with the greater number of burners. The second and each further distributors are arranged in a conduit for the fuel supply from the first distributor to the burners. It should be understood that these additional distributors can also have conduits for the fuel supply to the burners associated with them.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
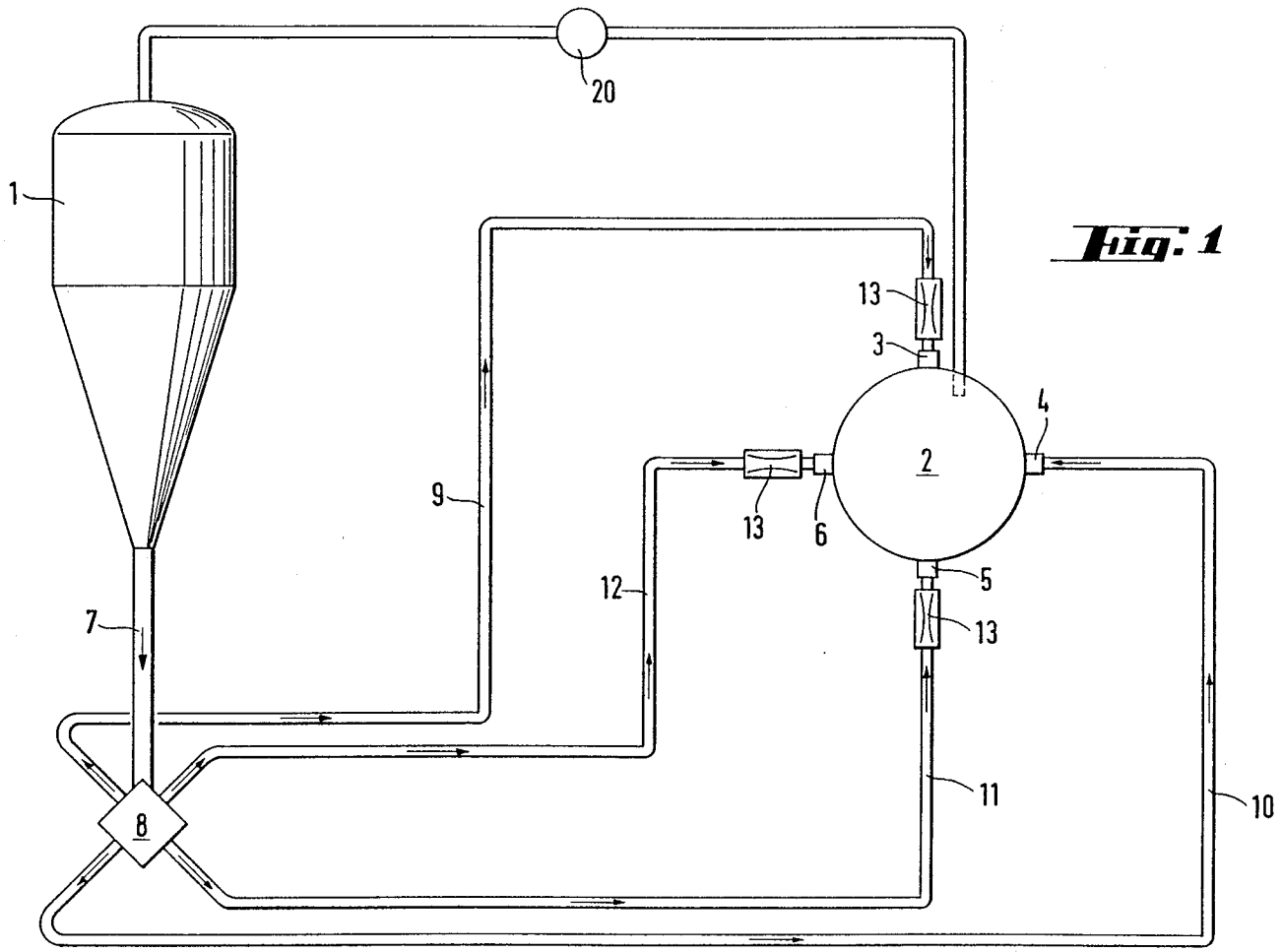
FIG. 1 is a view showing a flow diagram of an arrangement for gasification of fuels in accordance with the present invention, with a distributor.

An arrangement for gasification of fuels includes a supply container 1 which shown in FIG. 1 and used for accommodating the fuel to be gasified. The supply container 1 is under pressure so as to provide for a pneumatic transportation of the fuel through respective conduits to burners 3, 4, 5, 6 in a gasification reactor 2. For this purpose the fuel is withdrawn from the supply container 1 through a supply conduit 7 and supplied to a distributor 8. The distributor 8 is arranged relatively close underneath a funnel-shaped outlet of the supply container 1. As can be seen from the drawings both supply container 1 and the distributor 8 can be located at a certain distance from the gasification reactor 2.

Conduits 9, 10, 11 and 12 extend from the distributor 8 for supplying the fuel to the burners 3, 4, 5 and 6. As can be seen from the schematic showing in FIG. 1, the conduits have different lengths and directions. The different pressure losses in the conduit 9, 10, 11 and 12, resulting from their different lengths and directions, are compensated in accordance with the present invention by providing of throttles 13. The throttles operate so that at the point of entrance of the fuel in the burners 3, 4, 5 and 6, the pressure loss between the distributor 8 and the respective burner is equal in all cases. In other words, in the conduit which because of its length and direction has a smallest pressure loss, the operation of the throttle 13 must be strongest. Vice versa, in the conduit with the highest pressure loss no throttle 13 at all can be provided. In the embodiment shown in the drawings, such a conduit is the conduit 10. The details of the construction of the throttles 13 are explained hereinbelow.

Changes in the output of the gasification reactor 2 can be achieved by respective nominal value changes of a differential pressure regulator 20. The differential pressure regulator 20 can regulate the pressure difference between the supply container 1 and the gasification reactor 2. Alternatingly, the throttles 13 can be replaced with suitable regulating valves of a conventional construction which will maintain the fuel stream 2 through each burner identical or different. In this case the differential pressure between supply container 1 and the gasification reactor 2 can be maintained constant.

FIG. 1 shows only those parts of the arrangement which are necessary for illustrating the present invention. The specific details of the construction of such parts, such as for example, the supply container 1, the gasification reactor 2, the distributor 8, and the burners 3, 4, 5 and 6 are not provided, since they do not constitute the subject matter of the present invention. It should be emphasized that these parts can be formed as conventional parts with constructions suitable for this purpose. It is to be understood that the supply container 1 must be provided with respective devices for subsequent feeding of the fuel and for maintaining the constant pressure, which are not shown in the drawings. They can be formed as known aggregates required for this purpose, such as for example, pressure cup conveyor or sluice bin.

Figure 2:
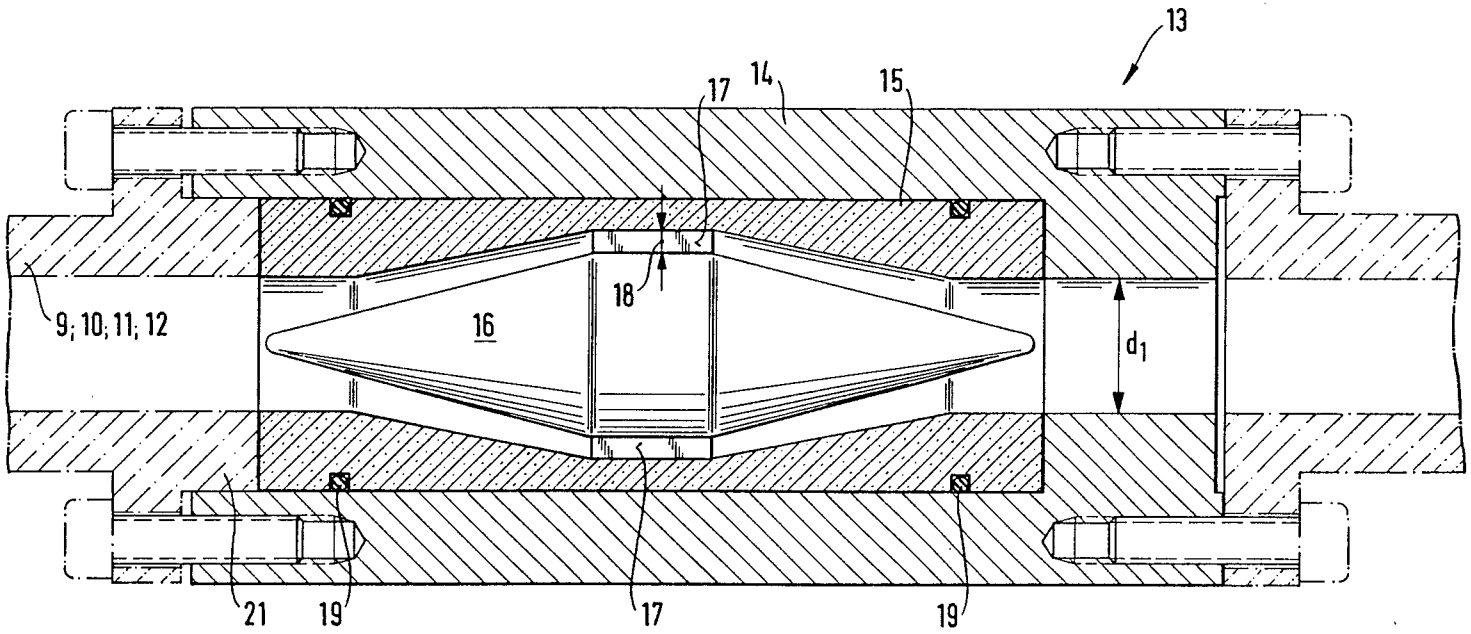
FIG. 2 is a view showing a section of a throttle which is used in the inventive gasification arrangement.

The details of the construction of the throttles 13 are shown in FIG. 2. This Figure shows a cross-section of the throttle. The throttle includes a cylindrical casing 14 with an outer diameter substantially corresponding to the flange diameter of the tubular conduit in which the throttle is inserted. Since the throttle is flanged in this tubular conduit, it is advantageous when the cylindrical casing 14 is composed of the same metallic material of which the tubular conduit is composed of. The cylindrical casing 14 has front and rear ends with inner diameter $d_1$ which corresponds to the inner diameter of the connected tubular conduit. A coating 15 is provided inside the cylindrical casing 14 and composed of a wear-resistant material such as for example ceramics. In some cases the coating can be assembled of several parts. The coating 15 has a shape which is designed so that it can receive a displacement body 16.

The displacement body 16 is composed of a wear-resistant material and connected inside the coating 15 by means of a web 17. A ring-shaped gap 18 is formed between the coating 15 and the displacement body 16. It corresponds to the height of the web 17. As can be seen from the drawings, the displacement body 16 has a cylindrical part in its center and two parts located at opposite sides of the cylindrical part and conically reducing toward the ends of the body.

The coating 15 is sealed inside the cylindrical casing 14 by sealing rings 19. The coating 15 is pressed into the casing 14 by a projection 21 on the flange of the tubular conduits to be connected. The pressure loss in the throttle is adjusted in accordance with the width and length of the ring-shaped gap 18, as well the fuel/supply gas speed in the annular cross-section of the gap 18. The gap 18 is greater than the tubular conduit which is guided in it with a diameter $d_1$.

The computation of a throttle which is suitable in condition of the so-called flow transportation is possible from experimentally obtained data with an accuracy of $\pm 5\%$. The insertion of the throttle has, in addition to the desired pressure loss, also the advantage in that the coarse particles in the fuel which lead to clogging, such as for example fibers, are retained and cannot be supplied to the burner. Otherwise, it would be difficult to remove them from the burner. It is to be understood that the design of the throttles must be such that their action is not too high and does not lead to disturbances in the fuel supply to the burners because of clogging of the conduits.

It should be mentioned that in addition to the distributor 8 shown in the drawings, also two or more distributors can be provided in the gasification arrangement in accordance with the present invention. In this case the second and each further distributor is arranged in a conduit for the fuel supply from the first distributor 8 to the burners 3, 4, 5 and 6. From these subsequent distributors again further conduits for the fuel supply to further burners are extended.

As can be seen from the drawings, the distributor 8 which is arranged underneath the supply container 1 is connected with the latter by a short supply conduit 7. This supply conduit 7 has no connection for an additional supply of a supplying or transporting gas.

It will be understood that each of the elements described above, or two or more together, may also find a useful application in other types of constructions differing from the types described above.

While the invention has been illustrated and described as embodied in an arrangement for gasification of fuels, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for gasification of fuels within the range from fine grain fuel to dust like fuels, in a dust cloud with gas, comprising a gasification reactor provided with at least two burners; a supply container for accommodating a fuel; a distributor connected to said supply container for receiving the fuel from said supply container; and at least two conduits having different lengths and extending between said distributor and said at least two burners, respectively, for supplying fuel from said distributor to said at least two burners respectively, wherein said conduits have different pressure losses due to the different lengths; and further comprising means for adjusting said different pressure losses so that at an entrance of the fuel in said burners a pressure difference between said distributor and a respective one of said burners is identical for all conduits, wherein said adjusting means includes throttles, wherein each of said throttles has a cylindrical casing provided with an inner coating and a displacement body located inside said casing so as to form a ring-shaped gap between said coating and said displacement body, wherein said displacement body has a central cylindrical part and two opposite parts extending from said cylindrical part and reducing in a conical manner toward both ends of said displacement body.

2. An arrangement as defined in claim 1, wherein said gasification reactor has a side wall, said burners being arranged in said side wall of said gasification reactor in one plane.

3. An arrangement as defined in claim 1, wherein said conduits include at least one conduit which has a highest pressure loss, said one conduit being formed without said adjusting means.

4. An arrangement as defined in claim 1; and further comprising further distributors each arranged in a respective one of said conduits; further conduits extending from each of said further distributors; and further burners provided in said gasification reactor and connected with said further conduits.

5. An arrangement as defined in claim 1, wherein said coating and said displacement body are composed of wear-resistant materials.

6. An arrangement as defined in claim 1, wherein said distributor is located vertically under said supply container; and further comprising a supply conduit connecting said supply container with said distributor and having no connection for an additional supply of a transporting gas.

* * * * *